US005830273A

United States Patent [19]

Zimmerman

[11] Patent Number: 5,830,273

[45] **Date of Patent: *Nov. 3, 1998**

[54] WORKPIECE SUPPORT

[76] Inventor: Robert L. Zimmerman, 6627 N. 29th St., Oakdale, Minn. 55128-3801

[ * ] Notice: The terminal 8 months of this patent has been disclaimed.

[21] Appl. No.: 473,085

[22] Filed: Jun. 7, 1995

[51] Int. Cl.[6] ..... B05C 21/00

[52] U.S. Cl. ..... 118/502; 269/905; 248/159

[58] Field of Search ..... 269/905; 118/500, 118/502; 248/159, 351, 523, 525

[56] References Cited

U.S. PATENT DOCUMENTS

| | | | |
|---|---|---|---|
| 684,097 | 10/1901 | Quigley | 118/500 |
| 855,219 | 5/1907 | Anthony, Jr. | 118/502 |
| 1,084,504 | 1/1914 | Thayer | 118/502 |
| 1,723,216 | 8/1929 | Stam | 248/159 |
| 3,861,662 | 1/1975 | Morse | 269/905 |
| 4,239,197 | 12/1980 | Olstad | 269/905 |
| 5,090,648 | 2/1992 | Wood, IV | 269/905 |
| 5,164,011 | 11/1992 | Ray | 118/502 |
| 5,228,737 | 7/1993 | Zimmerman | 248/351 |
| 5,288,090 | 2/1994 | Bross | 269/905 |

FOREIGN PATENT DOCUMENTS

| | | | |
|---|---|---|---|
| 2331879 | 1/1974 | Germany | 248/159 |

*Primary Examiner*—Brenda A. Lamb
*Attorney, Agent, or Firm*—Dorsey & Whitney LLP

[57] ABSTRACT

The present invention provides a support for enabling a door to be painted or finished conveniently without interference or obstruction. The support is an elongated member having first and second ends. Adjacent to one end, the member includes a hole and a flange structure with another hole aligned with the hole in the member for removably receiving a nail such that the sharp tip and a portion of the nail is exposed. In use, the nail is set in the top edge of the door and the second end of the support is rested against a wall. Thus supported, there is unobstructed access to the two long side edges and two main sides of the door. A fulcrum is provided along the member, more closely adjacent to the end with the flange structure than to the other end, to assist in levering the member, particularly the nail, free of the door after it is finished.

10 Claims, 2 Drawing Sheets

WORKPIECE SUPPORT

TECHNICAL FIELD

The present invention relates to supports. More particularly, it relates to a brace support for supporting a workpiece so that more than one surface of the workpiece may be treated conveniently and efficiently without repositioning the workpiece while it is supported.

BACKGROUND OF THE INVENTION

Dipping or immersing an object is one way to efficiently coat it on more than one side. The dipping process is well-suited for production line or factory use, but not for use at a temporary, remote job site (e.g., the construction site of a new home) because it obviously requires a tank or container large enough to contain accommodate the object to be coated. Also, an object gripping and transporting feature has to be provided to transport the object to be coated into and out of the liquid coating material filling the container. Even if it were practical to provide and use a dipping system on a job site, after dipping, a wet, coated object still needs to be handled and supported while drying.

Spray coating is a practical, efficient way to coat objects at a building site. Generally, in addition to the coating material, all that is required is a compressor, conduit and a spray head. These items are generally easily portable. Walls, ceilings and other fixed features are easy to spray coat with paint or other material. Movable objects such as doors and windows present more difficulty, because when hung in their operative positions, one or more sides or edges are exposed at all times. The latter situation requires that the finish on more than one, frequently more than two, surfaces be unmarred.

Whether spraying, or using a more traditional handheld brush, one time consuming way to ensure a clean, unmarred finish is to support a workpiece so that a first side or edge is exposed and can be coated without interference, then coat that side or edge and wait until it's dry. The workpiece may then manipulated and resupported to expose a second side or edge for coating. This process must be repeated for each, or almost each, surface to be coated. Even if this time consuming method is used, a dry, finished side or edge is likely to be marred by handling or contact with the support structure.

What is needed is an easily portable support for supporting a workpiece so that more than one surface or edge may be treated conveniently and efficiently without repositioning the workpiece and without marring a workpiece surface visible when the workpiece is in its operative position.

SUMMARY OF THE INVENTION

The present invention provides a support for supporting a workpiece, particularly a door, shutter, window or the like, so that more than one surface or edge thereof may be treated without repositioning the workpiece while it is supported, without interference or obstruction and without marring a surface later visible when the workpiece is installed.

The support comprises an elongated member having first and second ends. Adjacent to one end, the member includes a nail receiving structure for removably receiving a nail such that the nail head, sharp tip and a portion of the length of the nail are exposed. In use, the nail is set in the uppermost edge of a door or the like and the support is positioned generally perpendicular with respect to the main sides (i.e., the front and rear sides) of the door or the like so the second end of the support may rest against a wall or other fixed object. The elongated member is of sufficient length so that, thus supported, there is unobstructed access to the two long side edges and two main side panels of the door.

A feature of the present invention is a fulcrum structure provided along the member, more closely adjacent to the end with the nail receiving structure than to the other end, to assist in levering the member, particularly the nail, free of the door after it is dry.

It is an object of the present invention to provide a support for supporting a workpiece so that the workpiece may be treated conveniently and efficiently without damaging it or a treated surface before, during or after treatment.

Another object of the present invention is to provide a single-piece support brace for supporting a door, window, shutter, panel or the like substantially in its operative position, even though it is removed from its hinge or frame support structure, wherein the door, window, shutter or the like rests on its bottom end edge and the support brace is removably coupled to the top end edge without contacting the two main, visible facing panels or two side edges.

Yet another object of the present invention is to provide easy access to the front and rear sides of a door so that a coating, such as stain, varnish, paint or the like, can be applied to both sides without moving, handling or repositioning the door.

Other objects, features and advantages of the present invention will become more fully apparent and understood with reference to the following specification and to the appended drawings and claims.

DETAILED DESCRIPTION OF THE PREFERRED EMBODIMENT

Figure 1:
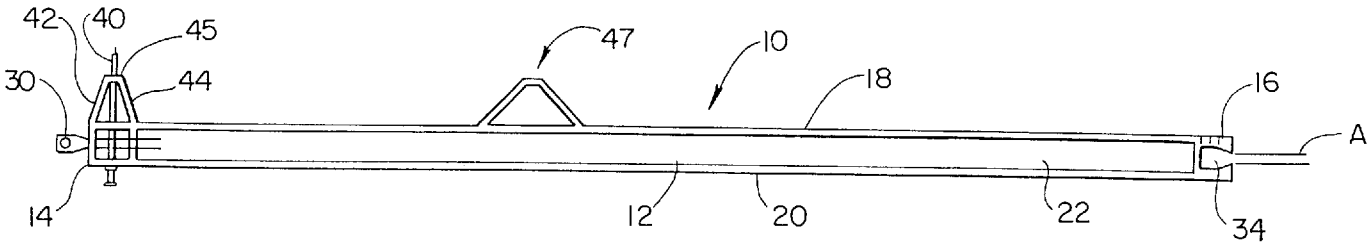
FIG. 1 is an elevational view depicting the support of the present invention.
Figure 2:
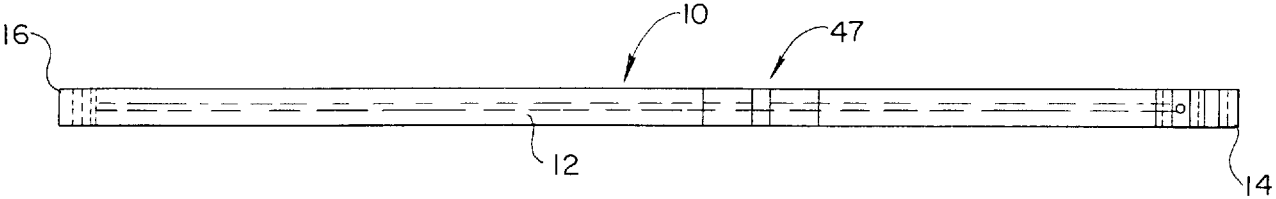
FIG. 2 is a top plan view of the present invention.

Referring to the FIGS., FIG. 1 depicts that the support 10 of the present invention comprises a single-piece, generally straight elongated member 12, with a first end 14 and a second end 16. (Unless specifically stated otherwise, references to front and back, top and bottom and first and second are intended for convenience of description only, not to limit the present invention or its components to any one positional or spatial orientation.) The member 12 extends substantially continuously between the ends 14, 16 and has a central longitudinal axis, indicated at A. The member 12 has the cross-sectional shape of an I-beam, including a pair of generally parallel top and bottom side walls 18, 20 connected by a central web 22 generally perpendicular to the two side walls 18, 20. The web 22 and/or side walls 18, 20 may be broken away as desired to provide for ease in handling and storage (hanging) and reduction of weight, as long as the strength and rigidity of the member 12 is not compromised.

Figure 3:
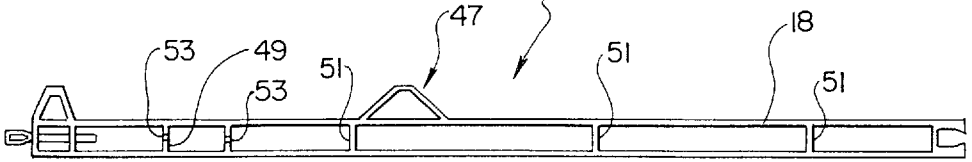
FIG. 3 is an elevational view depicting additional features of the present invention.
Figure 4:
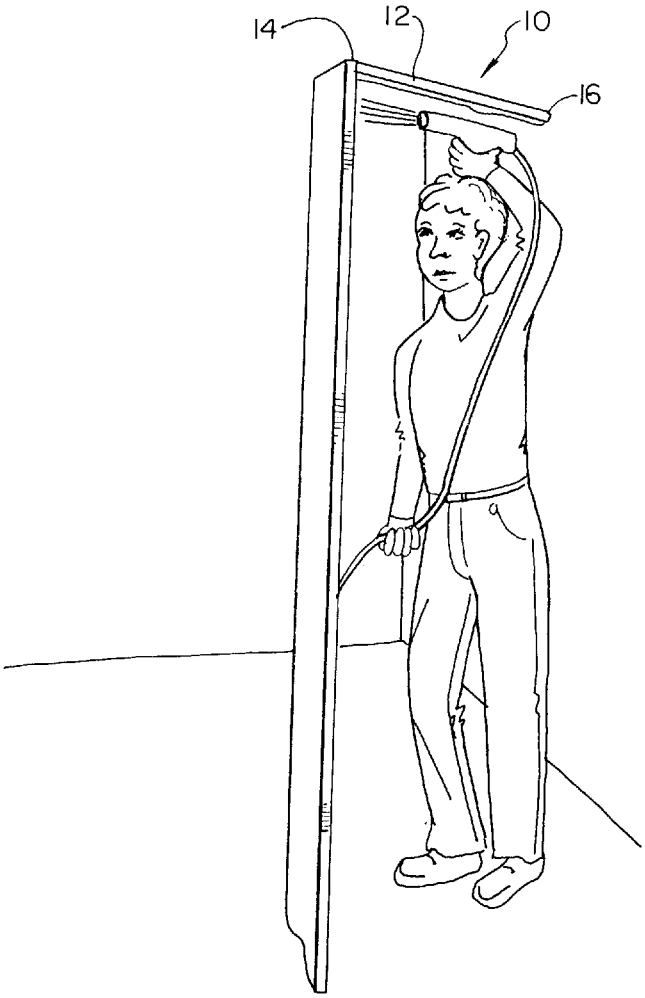
FIG. 4 depicts the support of the present invention in use supporting a door while both sides of the door are being spray painted.

With reference to FIGS. 1 and 3, the first end 14 carries one of two complementary members of a link means for releaseably linking two of the members 12 end-to-end to form a longer support structure for supporting a door farther away from a wall. The complementary member at the first end 14 is a generally rectangular projection 30 fixedly and substantially rigidly connected to the first end 14 and extending away therefrom generally along said longitudinal axis A. The edges of the projection 30 are beveled.

The second of the two complementary members of the link means is provided at the second end 16 of the member 12 and comprises a notch 34 for releaseably receiving the projection 30. The edges of the notch 34 are beveled to make it easy to insert and remove the projection 30.

Referring to FIGS. 1 and 3, the member 12 is adapted to removably receive a nail 40 near the first end 14. Two outstanding flanges 42, 44 are carried adjacent to the first end 14 on one side 18 of the member. A first end of both flanges, which extend away from the side of the member 12 at an angle and converge, is connected to that side of the member. A nail stopping plate 45 is connected to the second end of said flanges and is generally parallel to the side 18 of said member 12 carrying the flanges. The plate 45 provides that the nail does not get driven into the top edge of the door too deeply. A first aperture is provided in the member 12 between the first ends of the flanges, and a second aperture is provided in the plate 45. The first and second apertures are generally aligned with respect to each other and each may include a peripheral edge with a flexible region, facilitating the insertion of a nail therein. In the preferred embodiment, the apertures may be offset slightly with respect to each other, enough to insure that the nail fits tightly therein, but not enough to make it too hard to insert the nail.

As depicted in FIGS. 1 and 3, a fulcrum 47, comprising a raised portion along the length of said member 12, is provided on one side 18 of the member 12, the same side 18 carrying the flanges 42, 44. The fulcrum 47 is more closely adjacent to the first end than to the second end of the member, and is provided to assist in removing the nail from the top edge of a door.

Preferably, the support member 12 is formed from plastic and has a uniform thickness to dry easily in the mold, and for strength and durability. To help in the drying further, the member 12 may have relieved areas 49. For strength, the member 12 may have a plurality of ribs 51 spaced along its length, along the web 22. Two of the ribs 51 are provided with relieved areas 53 to provide a nail clip for storing a the nail and for providing a nail at the point of sale. The member 12 may have one or more smooth logo receiving area(s) 55 for carrying the name of a user or advertiser.

Unless specifically described otherwise, material for forming the present invention may selected from appropriate plastics or other synthetics, various polymers, mixtures of polymeric materials, wood, metal, metallic alloys or combinations thereof. Means for fastening, mounting, attaching or connecting components of the present invention to form the support and the extended support embodiment (depicted in FIG. ) are intended to encompass conventional fasteners such as typical male/female threads, bayonet type connectors, friction or press fit arrangements, screws, rivets, nuts and bolts, nails, pins, or the like. Other fastening or attachment means appropriate for connecting components include adhesives, brazing or welding, including sonic welding.

Although a description of a preferred embodiment has been presented, various changes including those mentioned above could be made without deviating from the spirit of the present invention. It is desired, therefore, that reference be made to the appended claims rather than to the foregoing description to indicate the scope of the invention.

What is claimed is:

1. A support brace for supporting a workpiece with two sides and two workpiece ends whereby, when supported, the two sides of the workpiece are free, said support brace comprising:

an elongated member having a first support end, a second support end, two sides, a length extending between said ends and a longitudinal central axis;

means for removably attaching the support brace to the workpiece two outstanding flanges carried adjacent to said first support end on one of said sides, a first end of said flanges connected to said one side, a plate connected to a second end of said flanges, whereby said plate is supported by said flanges and is generally parallel to said one side of said member carrying the flanges, a first aperture in said member between said first ends of said flanges and a second aperture in said plate, said first and second apertures aligned with respect to each other and provided for removably receiving the means for removably attaching said support brace to the workpiece; and a raised portion along the length of said member on said one side of said member carrying the flanges, said raised portion for assisting in releasing said support brace from a workpiece and more closely adjacent to said first support end than to said second support end.

2. The support brace according to claim 1, wherein said elongated member is a single piece.

3. The support brace according to claim 1, wherein said means for removably attaching said support brace to the workpiece comprises tack means.

4. The support brace according to claim 3, wherein said tack means is transverse to said longitudinal central axis and extends past said plate when the support brace is attached to a workpiece.

5. The support brace according to claim 3, wherein, during use, said support brace is unsupported against deflection and bending moment throughout the length thereof.

6. The support brace according to claim 4, wherein, when said support brace is attached to the workpiece, said elongated member is generally transverse with respect to the two sides of the workpiece.

7. The support brace according to claim 1, further comprising a projection carried by said elongated member at said first support end and a notch carried by said elongated member at said second end for releaseably receiving said projection, whereby two of said elongated members may be releaseably linked end-to-end.

8. A support brace for supporting a door to be coated with a coating, said door having two generally parallel side edges, an upper and lower edge, each generally perpendicular to the side edges and two main sides, whereby, when the door is supported, the two main sides of the door are free and the support brace does not interfere with the coating of the main sides, said support brace comprising:

an elongated member having a first support end, a second support end, two sides, a length extending between said ends and a longitudinal central axis;

means for removably attaching said support brace to the door;

two outstanding flanges carried adjacent to said first support end on one of said sides, a first end of said flanges connected to said one side, a plate connected to a second end of said flanges, whereby said plate is supported by said flanges and is generally parallel to said one side of said member carrying the flanges, a first aperture in said member between said first ends of said flanges and a second aperture in said plate, said first and second apertures aligned with respect to each other and provided for removably receiving the means for removably attaching said support brace to the workpiece; and a raised portion along the length of said member on said one side of said member carrying the flanges and spaced from said flanges, said raised portion for assisting in removing said support brace from a door and more closely adjacent to said second support end than to said second support end.

9. The support brace according to claim 8, further comprising link means for linking two of said support braces.

10. The support brace according to claim 9, wherein said link means comprises a projection carried by said member at said first end and means for releaseably receiving said projection at said second end, whereby two of said members may be releaseably linked end-to-end.

* * * * *